US007383591B1

(12) United States Patent
Getzwiller et al.

(10) Patent No.: US 7,383,591 B1
(45) Date of Patent: Jun. 10, 2008

(54) EXERCISE MITT

(75) Inventors: Gail M. Getzwiller, 51 E. Pinto Trail, Sonoita, AZ (US) 85637; Regina L. Igini, Sonoita, AZ (US)

(73) Assignee: Gail M. Getzwiller, Sonoita, AZ (US)

( * ) Notice: Subject to any disclaimer, the term of this patent is extended or adjusted under 35 U.S.C. 154(b) by 0 days.

(21) Appl. No.: 10/356,828

(22) Filed: Feb. 3, 2003

Related U.S. Application Data

(60) Provisional application No. 60/354,448, filed on Feb. 4, 2002.

(51) Int. Cl.
*A41D 19/00* (2006.01)

(52) U.S. Cl. ..... 2/161.1; 36/114; 482/96

(58) Field of Classification Search ..... 2/16, 2/20, 160, 239, 161.1–161.3, 161.5, 161.6; 36/114, 59; 128/878, 879; 482/92, 93, 47, 482/49, 95, 96; 434/395, 397; 602/23
See application file for complete search history.

(56) References Cited

U.S. PATENT DOCUMENTS 482,647 A * 9/1892 Obear ..... 2/158
2,244,445 A * 6/1941 Carson et al. ..... 2/20
3,146,463 A * 9/1964 Wargo ..... 2/20
3,676,940 A * 7/1972 Shively ..... 36/8.1
4,103,362 A * 8/1978 Blakeman ..... 2/161.1
4,183,100 A * 1/1980 De Marco ..... 2/159
4,531,241 A * 7/1985 Berger ..... 2/161.2
4,569,707 A * 2/1986 Johnson ..... 156/78
4,958,384 A * 9/1990 McCrane ..... 2/161.6
5,479,660 A * 1/1996 Najac ..... 2/20
5,500,956 A * 3/1996 Schulkin et al. ..... 2/161.1
5,762,621 A * 6/1998 Schultz ..... 602/64
5,774,895 A * 7/1998 Baldwin ..... 2/161.1
5,971,240 A * 10/1999 Dequaine ..... 224/217
6,766,536 B1 * 7/2004 Aarons ..... 2/161.3

OTHER PUBLICATIONS www.yogasyz.com Yoga-Paws.*

* cited by examiner

*Primary Examiner*—Katherine Moran
(74) *Attorney, Agent, or Firm*—Lawrence R. Oremland, P.C.

(57) ABSTRACT

An exercise mitt is provided for a hand or foot, and which is particularly useful in an exercise form such as yoga in which a practitioner maintains a pose or shifts body position while his/her hand or foot is in contact with a support surface. The exercise mitt is specially configured to address the problem of slippage when the practitioner is practicing an exercise form such as yoga, where the practitioner exerts pressure on a support surface in both downward and outward directions as the practitioner is practicing the exercise form. The mitt comprises a sleeve configured to fit snugly about a portion of a human extremity while permitting portions of the human extremity to extend out of the sleeve. The sleeve has inner and outer surface portions with the outer surface portion configured to contact the support surface as the wearer takes predetermined positions relative to the support surface, the outer surface portion being further configured to resist the human extremity from sliding against the support surface, and the inner surface portion being configured to resist relative movement between the human extremity and the sleeve as the wearer applies pressure against the surface and takes predetermined positions relative to the support surface.

9 Claims, 7 Drawing Sheets

(right side)

(cutaway)

(front view)

(rear view)

(left side)

(top view)

(bottom view)

(right side)

(cutaway)

(front view)

(rear view)

(left side)

(top view)

(bottom view)

EXERCISE MITT

RELATED APPLICATION/CLAIM OF PRIORITY

Figure 1A:
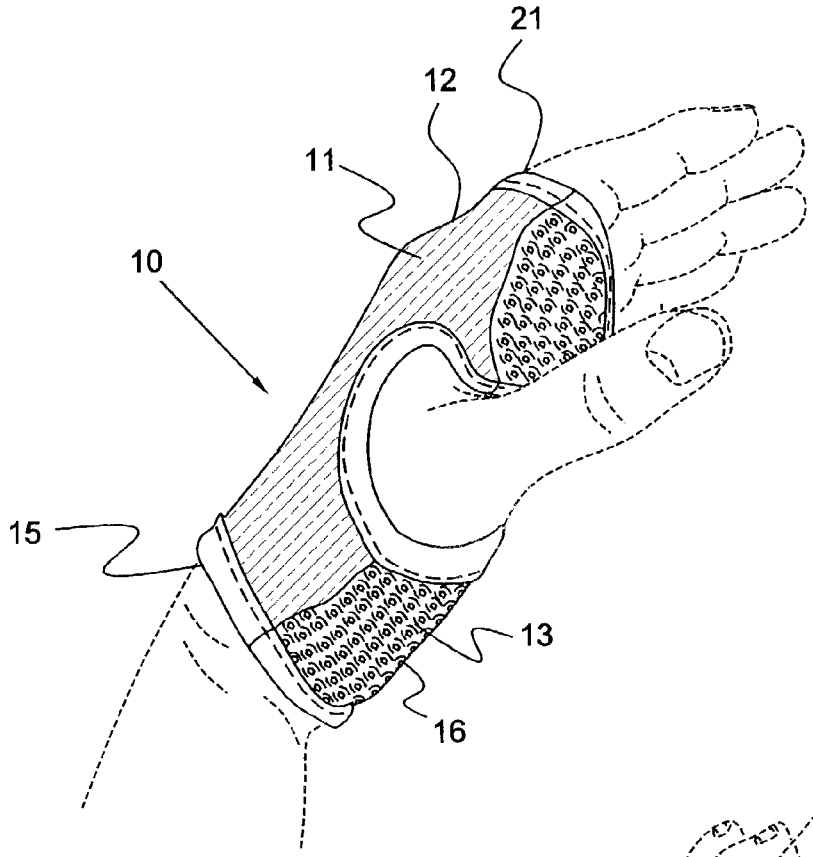

This application is related to and claims the priority of provisional Application Ser. No. 60/354,448, filed Feb. 4, 2002, and which provisional application is incorporated herein by reference. A copy of provisional application Ser. No. 60/354,448 is Attachment A hereto.

TECHNICAL FIELD

The present invention relates to an exercise mitt for a hand or foot, which is particularly useful in an exercise form such as yoga in which a practitioner maintains a pose or shifts body position while his/her hand and/or foot is in contact with a support surface.

BACKGROUND

The key to success in yoga is the ability to relax in the yoga poses, so that one's muscles are both strengthened and lengthened, even as one relaxes, breathes deeply, and meditates. Sometimes a pose is held for a considerable length of time, up to ten, or even thirty, minutes. What makes this challenging is the difficulty of the various poses, many of which require the student to exert pressure on the floor (though several different body parts) in both downward and outward directions. Slipping, which can result in failure to properly perform the posture, is a concern, and the control that one must exert to avoid slipping can interfere with one's ability to relax while holding the pose. This can, of course, be a particular problem for beginners.

One product that has been designed to address this problem is referred to as a "yoga mat;" a thin flexible pad, usually around two-and-a-half by six feet, with a rubbery, non-slip surface both on the top and the bottom. The student does the poses on top of the mat, which helps to keep him or her from slipping and also provides some padding for the poses in which the student is sitting or lying on the floor. Yoga practitioners now commonly use this type of mat.

Yoga has, in recent years, expanded dramatically in popularity. Yoga studios have cropped up seemingly everywhere and there are dozens of instructional videos on the market. Displays of these videos, along with yoga props (including, of course, the yoga mat) can be found not only in video and exercise stores but also in health food stores, up-scale supermarkets, department stores, and bookstores.

In the applicants' experience, there are some drawbacks to yoga mats. For example, if a yoga practitioner is traveling, and wants to practice yoga, the practitioner may find it necessary to carry the mat. Moreover, if a practitioner wants to practice in a room that is already carpeted, the practitioner may not feel the need or desire to use a mat. Still further, the aesthetic setting for the practitioner may be important, and the practitioner may prefer a setting that does not use a mat. For example, a yoga practitioner may find it important to practice yoga in a setting that includes beautiful woven wool rugs and may prefer to perform the yoga postures directly on those rugs, but the use of mats may detract from the aesthetics of the setting. In such circumstances, if a mat is not used, slippage can still be an issue for the practitioner.

SUMMARY OF THE PRESENT INVENTION

The present invention provides a specially configured exercise mitt for a practitioner's hands and/or feet designed to address the problem of slippage when the practitioner is practicing an exercise form such as yoga, where the practitioner exerts pressure on a support surface such as the floor or a carpet or rug in both downward and outward directions as the practitioner is practicing the exercise form. The mitt comprises a sleeve configured to fit snugly about a portion of a human extremity while permitting portions of the human extremity to extend out of the sleeve. The sleeve has inner and outer surface portions with the outer surface portion configured to contact the support surface as the wearer takes predetermined positions relative to the support surface. The outer surface portion is configured to resist the human extremity from sliding against the support surface, and the inner surface portion is configured to resist relative movement between the human extremity and the sleeve as the wearer applies pressure against the surface and takes predetermined positions relative to the support surface.

An exercise mitt according to the present invention is also designed to address a particular problem for yoga practitioners identified by the applicants in designing the mitt. Specifically, applicants determined that to be effective in an exercise form such as yoga, the mitt had to prevent slippage between the mitt and a support surface, and also prevent slippage between the mitt and the wearer's hand/foot, as the wearer exerts pressure in both downward and outward directions on a surface during the exercise form. In their research, applicants examined existing gloves such as weight lifting gloves, fishing gloves, batting gloves, even gardening gloves, but found that such products tended to be bulky and heavy and, more importantly, the applicants found that their hands inevitably slipped around inside these gloves, so that the skin between their fingers was jammed up against the material of the glove, which was very uncomfortable, or even painful. In other words, although some of the products stuck to the floor, they did not stick to the hand. Applicants found nothing for feet that even came close to what they envisioned.

Thus, in designing the exercise mitts of the present invention, the inventors effectively started from scratch, and sought to incorporate all the features they wanted in the mitts—comfortable and lightweight, with a sleeve having a snug fit (enhancing both comfort and resistance to slippage), covering only part of the extremity (yoga students are used to having bare hands and feet, and a partial coverage is more comfortable), with both an inside and outside non-slip surface. Although partial finger coverage can be incorporated into the exercise mitts, and is not inconsistent with their basic design, the inventors found that effective, comfortable mitts for the hands, and for the feet, can be made with no fingers at all. This enhances comfort and reduces bulk. The non-slip surface on the inside prevents the extremity from slipping out of the sleeve as downward and outward pressure is applied to a support surface.

The present invention is believed to have advantages over the yoga mat. Exercise mitts according to the invention are small (with a tiny fraction of the bulk of a yoga mat) and can thus be easily transported in a gym-bag, a suitcase (for travelers), or even a purse. They can also be easily stored at home, in a convenient drawer or niche wherever the user exercises—a much smaller niche than a mat requires. If one is wearing a cropped exercise top (or, in the case of a man, doing yoga without a shirt on), the skin of one's back tends to stick to a yoga mat when doing poses in the supine position. When one then moves from that position, the mat can shift and become wrinkled. Even ones hands and feet can stick, causing the same problem. The mitts of the present invention, however, don't "bunch up" or shift, like a mat, and they don't cause the users back to stick to the floor. The mitts also do not define and limit the user's workout space, as a mat does. Therefore, the user does not need to adjust his/her position simply to stay on the mat.

Additional features of the present invention will become further apparent from the following detailed description and the accompanying drawings and Attachment A.

BRIEF DESCRIPTION OF THE DRAWINGS AND ATTACHMENT

Figure 1B:
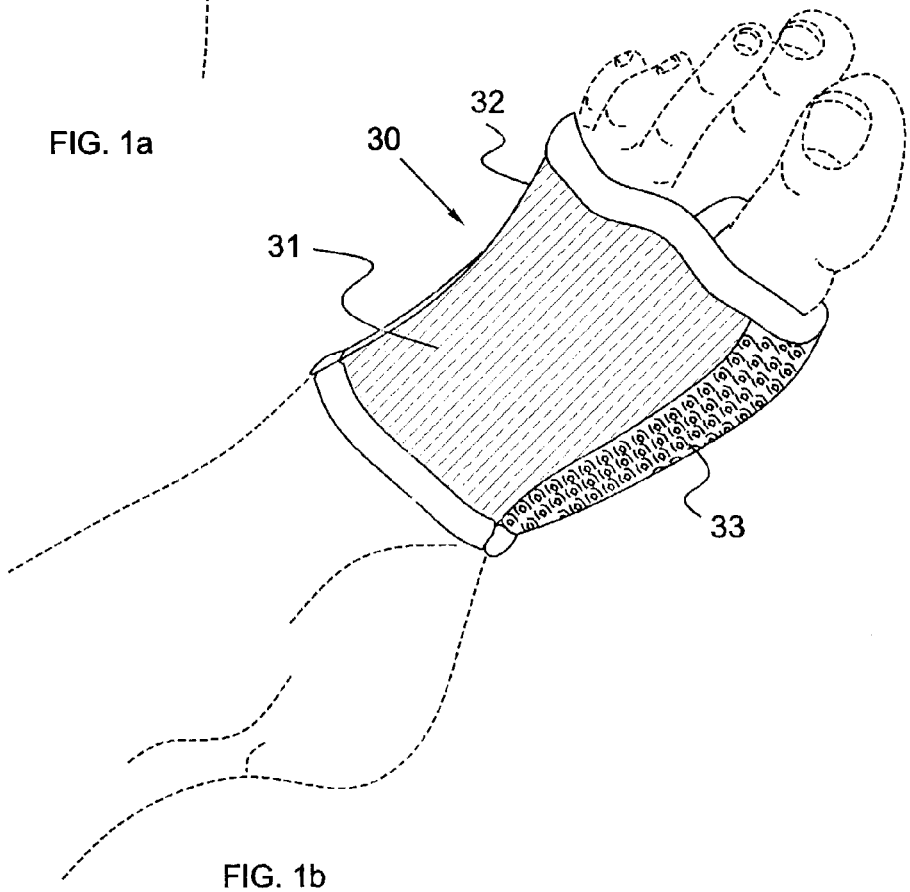
Figure 2A:
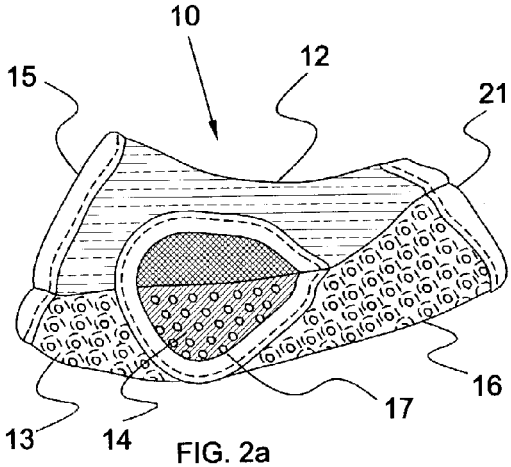

FIG. 1*a* a perspective view of an exercise mitt according to the present invention on a practitioner's hand;

FIG. 1*b* is a perspective view of an exercise mitt according to the present invention on a practitioner's foot;

FIG. 2*a* is a view of the right side of the exercise mitt of FIG. 1*a;*

Figure 2B:
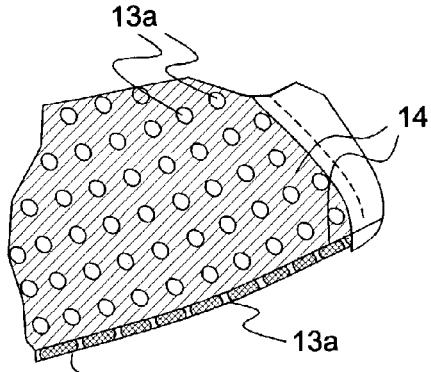
Figure 2C:
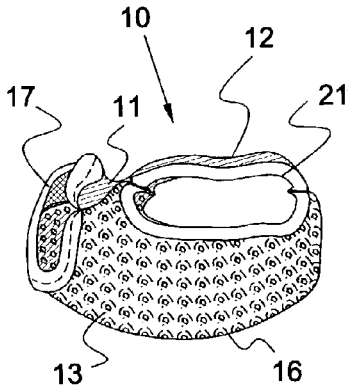

FIG. 2*b* is an enlarged, fragmentary, cutaway section of the perforated component of the exercise mitt of FIG. 1*a*, showing the inside surface of the perforated component, and showing part of the material of the perforated component in section;

FIG. 2*c* is a front view of the exercise mitt of FIG. 1*a;*

Figure 2D:
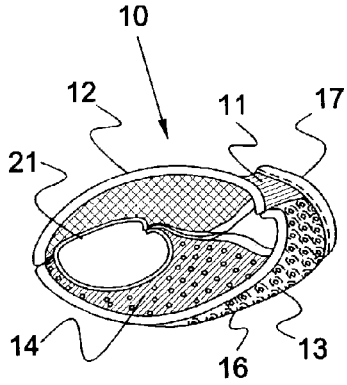

FIG. 2*d* is a rear view of the exercise mitt of FIG. 1*a;*

Figure 2E:
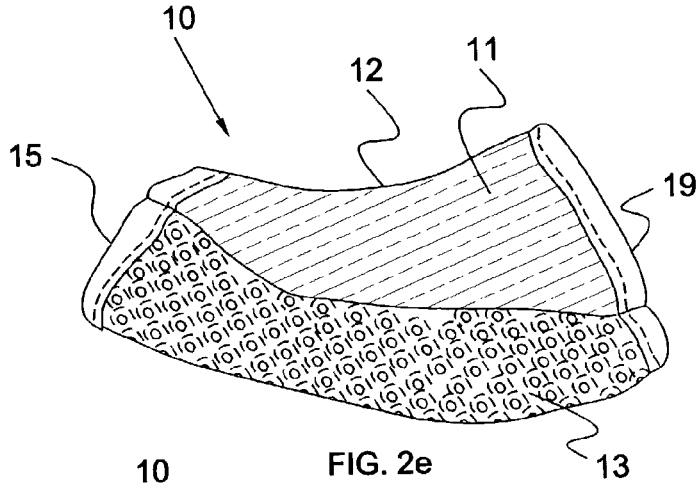

FIG. 2*e* is a left side view of the exercise mitt of FIG. 1*a;*

Figure 2F:
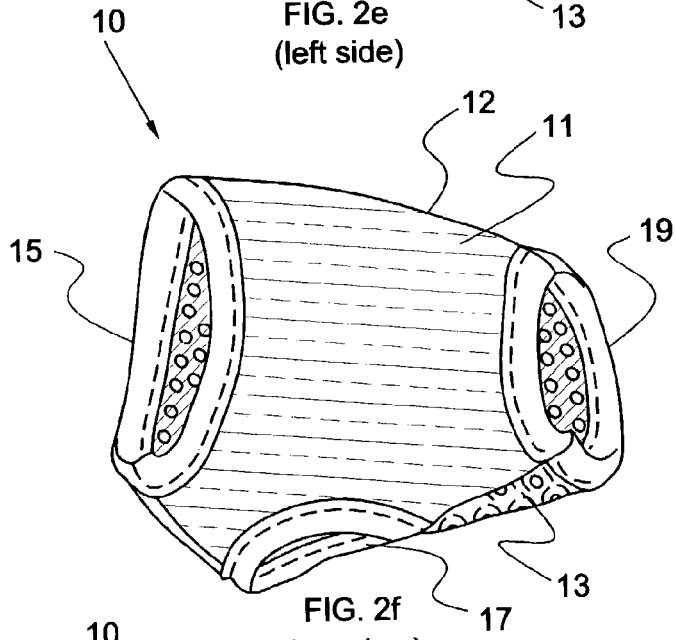

FIG. 2*f* is a top view of the exercise mitt of FIG. 1*a;*

Figure 2G:
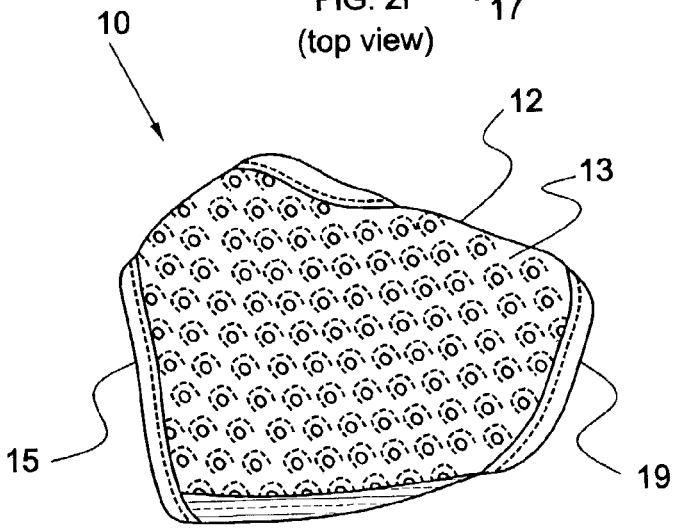

FIG. 2*g* is a bottom view of the exercise mitt of FIG. 1*a;*

Figure 3A:
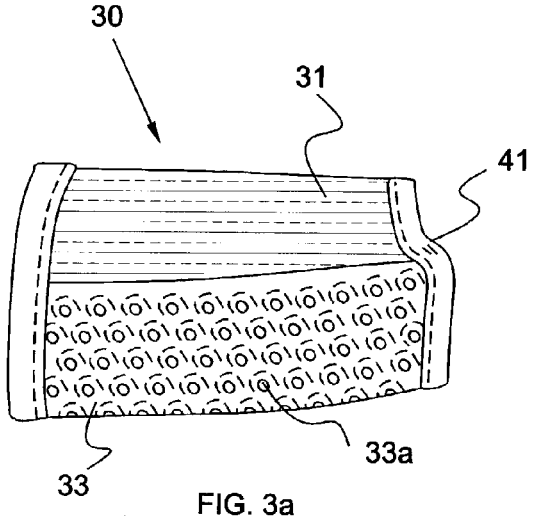

FIG. 3*a* is a view of the right side of the exercise mitt of FIG. 1*b;*

Figure 3B:
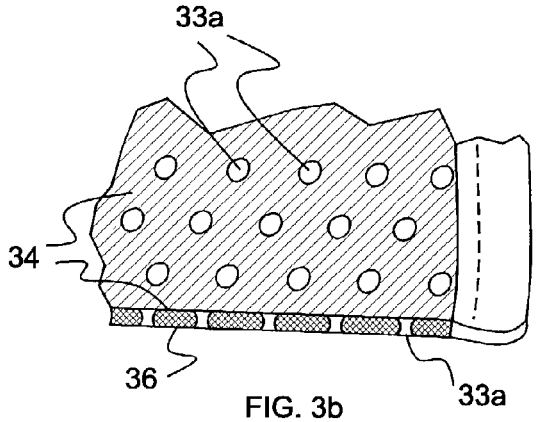
Figure 3C:
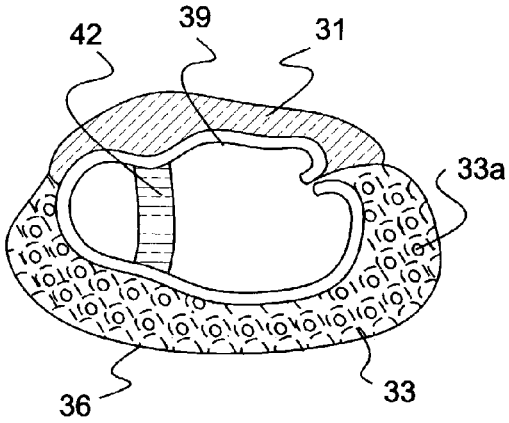

FIG. 3*b* is an enlarged, fragmentary, cutaway section of the perforated component of the exercise mitt of FIG. 1*b*, showing the inside surface of the perforated component, and showing part of the material of the perforated component in section;

FIG. 3*c* is a front view of the exercise mitt of FIG. 1*b;*

Figure 3D:
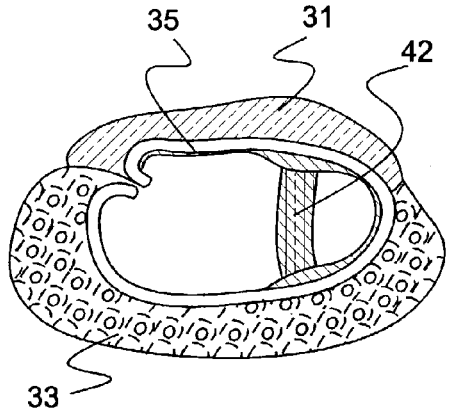

FIG. 3*d* is a rear view of the exercise mitt of FIG. 1*b;*

Figure 3E:
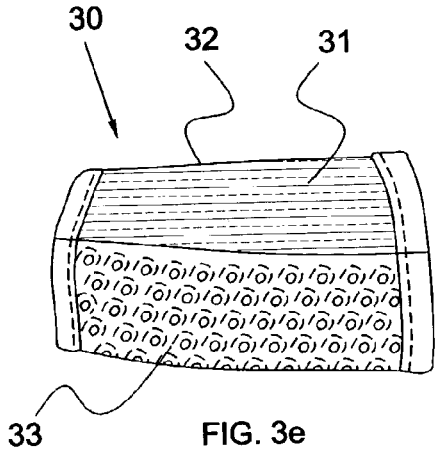

FIG. 3*e* is a left side view of the exercise mitt of FIG. 1*b;*

Figure 3F:
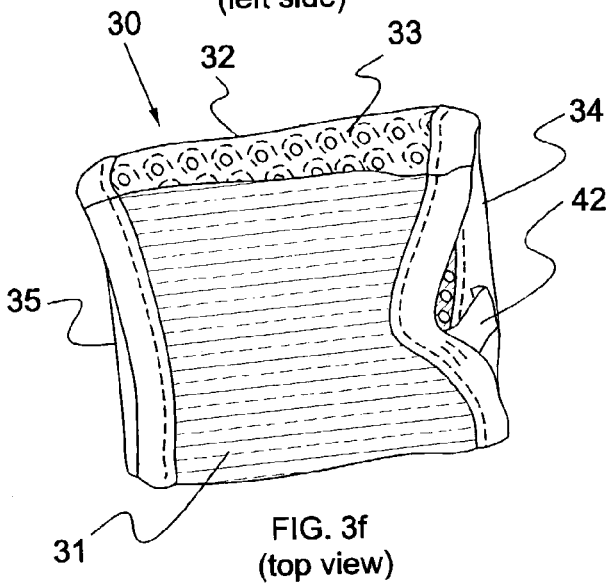

FIG. 3*f* is a top view of the exercise mitt of FIG. 1*b;*

Figure 3G:
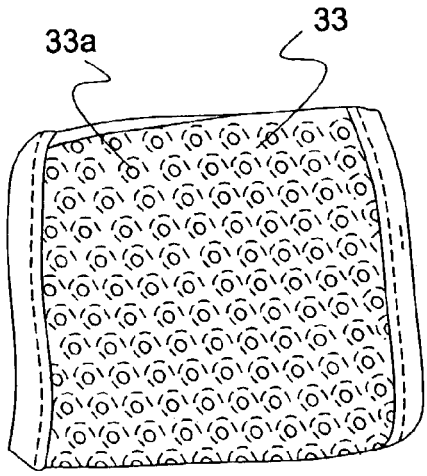

FIG. 3*g* is a bottom view of the exercise mitt of FIG. 1*b;*

Figure 4A:
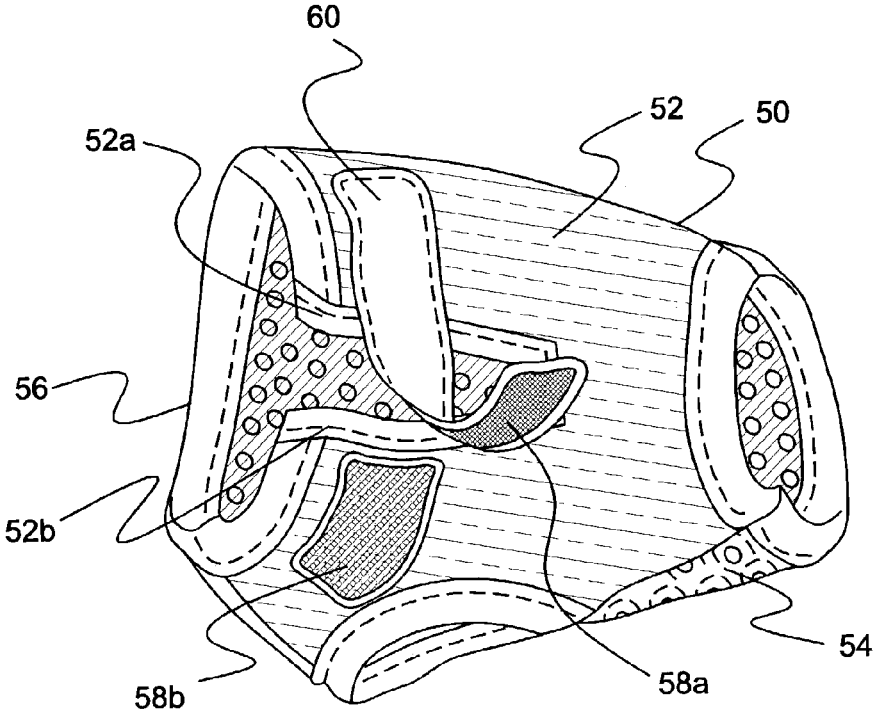
Figure 4B:
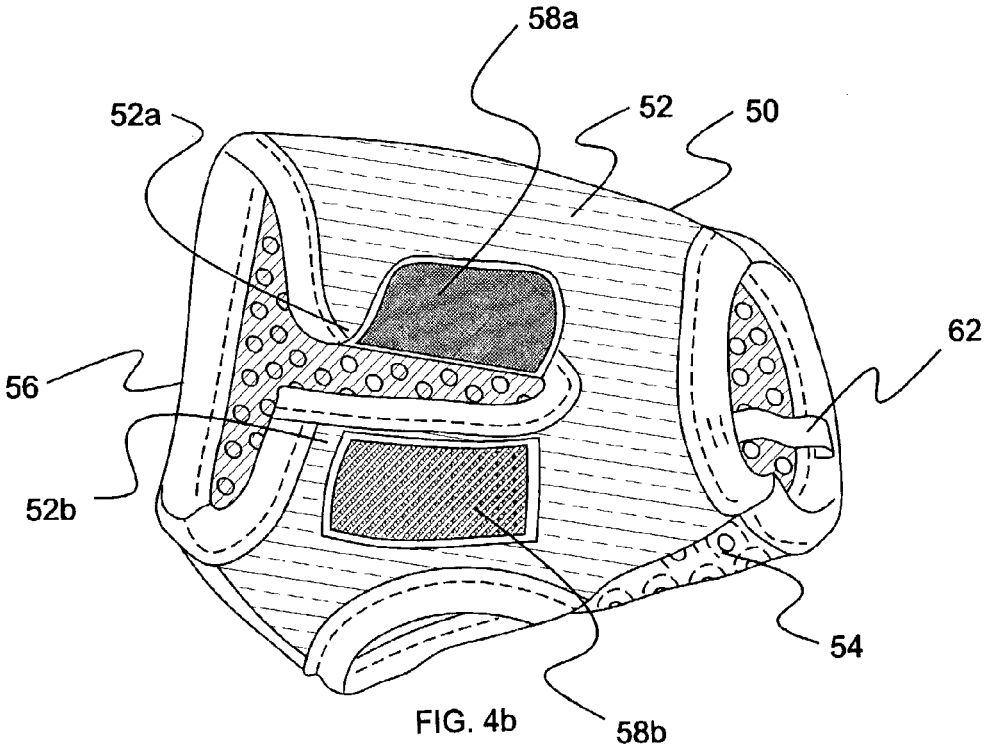
Figure 5:
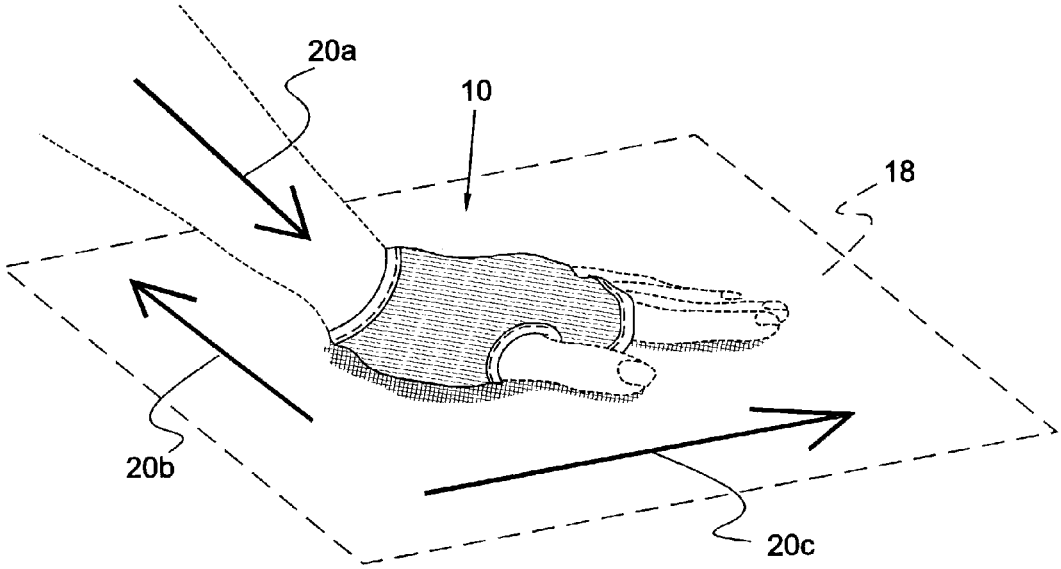
Figure 6:
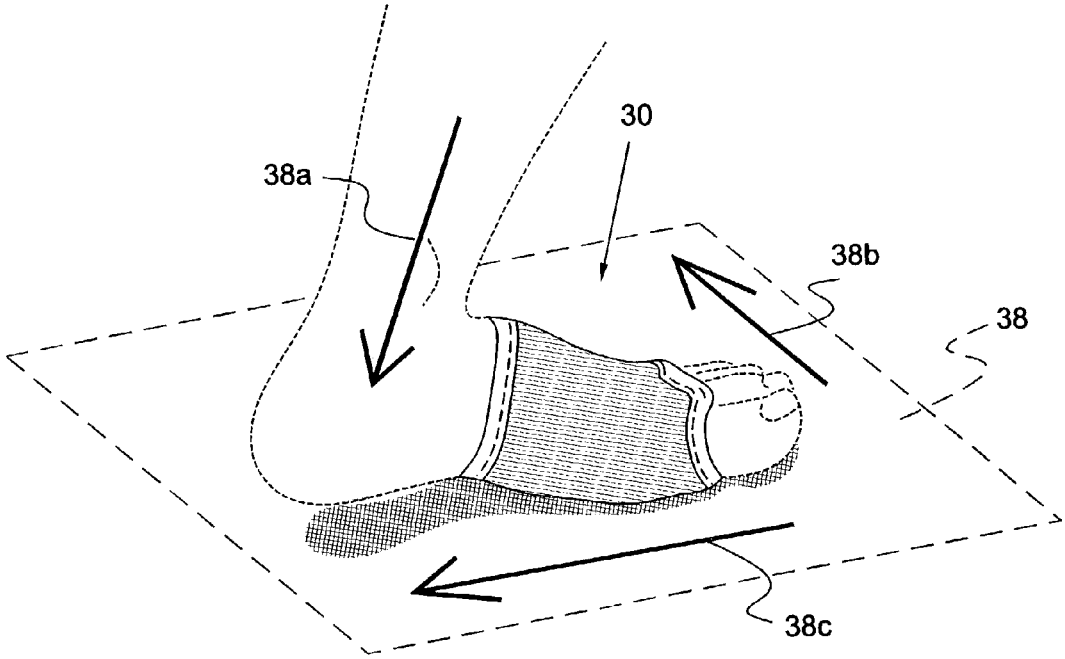

FIG. 4*a* is a top view of a left hand mitt according to the present invention, and showing an alternative way of securing the mitt to a practitioner's hand;

FIG. 4*b* is a top view of a left hand mitt according to the present invention, and showing another alternative way of securing the mitt to a practitioner's hand; and FIGS. 5 and 6 are schematic illustrations of a yoga practitioner's hand and foot, while the practitioner is in yoga poses on a support surface and showing how hand and foot mitts according to the present invention resist slippage of the practitioner's hand and foot as the practitioner puts pressure in downward and outward directions relative to the support surface.

Attachment A shows several early versions of an exercise mitt according to the principles of the present invention.

DETAILED DESCRIPTION

As set forth above, the present invention provides an exercise mitt which is particularly useful in the practice of an exercise form such as yoga. The present invention is described below in connection with mitts designed and useful in the practice of yoga, but it will be clear to those in the art that the principles of the invention are useful in the configuration of mitts that are useful for similar exercise forms (e.g. pilates) where the practitioner is required to apply pressure in both downward and outward directions against a support surface as the practitioner shifts positions relative to the support surface.

FIGS. 1*a*, 2*a*-2*g* illustrate one version of a hand mitt 10 according to the principles of the present invention. The mitt includes a sleeve 12 configured to fit snugly about a portion of a wearer's hand while permitting portions of the hand to extend out of the sleeve. A wearer's hand is inserted into the sleeve through a rear opening 15 of the sleeve. As the wearer's hand is properly fitted into the sleeve, the wearer's thumb extends through a thumb opening 17 in the sleeve, and the remaining fingers of the wearer extend through an opening 19 in the front end 21 of the sleeve 12.

Sleeve 12 is formed by a stretch component 11 and a perforated component 13 that are coupled together (e.g. they are sewn together). The stretch component 11 is formed e.g. of material such as a woven blend of cotton, nylon and/or polyester, which will stretch to enable a wearer to insert a hand into the sleeve, and then contract the sleeve to a snug fit against the wearer's hand. The perforated component 13 is formed e.g. of foam material that is a poly vinyl chloride blend (of a type distributed by Bkeha Yoga Supplies Co., Ashland, Oreg., as "XT-PERFORATED (AKA the holy mat)" and "CODE=XTPERF"), and has inner and outer surface portions 14, 16, respectively. The outer surface portion 16 is configured to contact a support surface (e.g. a rug) as the wearer takes predetermined positions relative to the support surface.

In the mitt of FIGS. 1, 2*a*-2*g*, the outer surface portion 16 is configured to resist the wearer's hand from sliding against the support surface and the inner surface portion 14 is configured to resist relative movement between the wearer's hand and the sleeve 12 as the wearer applies pressure in downward and outward directions against the support surface. As illustrated in FIG. 5, when a practitioner applies force on the surface 18 (e.g. in the direction 20*a*), the mitt resists slippage of the practitioner's hand in directions parallel to the surface (e.g. in directions 20*b*, 20*c*).

The stretch component 11 of the sleeve 12 enables the sleeve to fit snugly about the portion of the human extremity. Specifically, the stretch component enables the rear opening 15 to widen as a wearer inserts a hand into the sleeve, and then causes the sleeve to contract to a snug fit about the wearer's hand. The sleeve 12 may be designed in standard sizes (e.g. small, medium, large, etc) in accordance with conventional glove or mitten sizing. Also, the sleeve is made as thin as possible to enable the wearer (e.g. a yoga practitioner) to more effectively "feel" the support surface through the covered portion of the practitioner's hand/foot.

FIGS. 1*b*, 3*a*-3*g* show a mitt 30 configured for a practitioner's foot. The construction of the mitt 30 is generally similar to the hand mitt 10 of FIG. 1*a*, in that it comprises a sleeve 32 formed by a stretch component 31 coupled to a perforated component 33. The stretch component 31 and the perforated component 33 are formed of the same types of materials described in connection with the hand mitt of FIG. 1*a*. The stretch component 31 enables a rear opening 35 in the mitt to stretch to enable a wearer to insert a foot into the sleeve, and then contract the mitt to a snug fit against the wearer's foot. The front end 41 has an opening 39, through which the wearer's toes extend when the mitt is properly fitted on the wearer's foot. The perforated component 33 has inner and outer surfaces 34, 36, respectively, which have the same function as the inner and outer surfaces of the hand mitt.

As illustrated in FIG. 6, when a practitioner who is wearing the foot mitt takes positions in which the practitioner applies downward and outward pressure to a support surface 38 (e.g. in the direction shown by arrow 38*a*), the outer surface 36 resists movement of a practitioner's foot relative to the support surface (e.g. in directions 38*b*, 38*c*). The inner surface 34 of the perforated component resists relative movement between the practitioner's foot and the mitt.

In the foot mitt of FIGS. 1*b*, 3*a*-3*g*, sleeve 32 is configured to fit snugly about the ball (and possibly part of the arch) of a human foot, and the wearer's toes extend through the front opening 39 in the mitt. A segment of material 42 extends across the front opening 39, divides the front opening and provides the front opening with a comfortable separation of the wearer's big toe from the remainder of the toes. Moreover, it is contemplated that it may also be useful to provide a similar segment of material in a hand mitt, oriented so as to be located across the front opening in the hand mitt and between the first and second fingers of the wearer. For example, in the version of the left hand mitt shown in FIG. 4*b*, a segment of material 62 extends across the front opening of the mitt, and is designed to be located between the first and second fingers of a wearer.

In the version of the mitt shown in FIGS. 4*a* and 4*b*, a sleeve 50 is formed by a fabric component 52 coupled to a perforated component 54. The perforated component 54 is similar to the perforated component of FIGS. 1*a*, 2*a*-2*g*. The fabric component 52 has a pair of flaps 52*a*, 52*b* that can separate to widen the rear opening 56 through which a hand can be inserted into the mitt. The flaps 52*a*, 52*b* have respective coupling portions 58*a*, 58*b*, that can be coupled together to tighten the sleeve to a snug fit about a wearer's hand. For example, in the mitt of FIG. 4*a*, the flap 52*a* has a strap 60 and the coupling portion 58*a* is a piece of Velcro material fixed to the strap 60. The flap 52*b* has a mating piece of Velcro that forms the coupling portion 58*b*. The Velcro couplings on the strap 60 and the flap 52*b* enable a wearer to tighten the sleeve 50 to a snug fit about the wearer's hand. In the mitt of FIG. 4*b*, the flap 52*a* has the Velcro coupling portion 58*a* on its inside surface, so that by overlapping the flaps 52*a*, 52*b* and coupling the Velcro portions 58*a*, 58*b*, the sleeve 50 can be tightened to a snug fit about a wearer's hand. The versions of the mitts shown in FIGS. 4*a*, 4*b*, provides some flexibility in the selection of the fabric component 52, since it may not be necessary to rely exclusively on the capability of that component to stretch and then contract, to cause the sleeve to fit snugly about a wearer's hand. Moreover, the type of coupling illustrated in FIGS. 4*a* and 4*b* allows a single mitt structure for a hand to be snugly fit to a variety of hand sizes. Specifically, the flaps 52*a*, 52*b*, allow the rear opening 56 to be selectively widened, to accommodate hands of different sizes. In addition, it will be clear that similar alternative types of couplings can be applied to a foot mitt, to enable and a single version of mitt for a foot to be snugly fit to a variety of foot sizes.

In the mitts shown in the Figures, the outer surface portions of the perforated components resist the human extremity from sliding against a support surface, and the inner surface portions of the perforated components resist relative movement between the human extremity and the sleeve 12 as the wearer applies pressure downward and outward against the surface and takes predetermined positions relative to the support surface. By outward, applicants mean pressure that would tend to cause a hand/foot to move in direction(s) parallel to the support surface (i.e. in any or all of the directions shown by arrows 20*b*, 20*c* in FIGS. 5 and 38*b*, 38*c* in FIG. 6).

In the foregoing embodiments, the perforated component (e.g. 13, 33) has openings (13*a*, 33*a*, respectively) that allow air to communicate with the wearer's hand or foot. Moreover, in a hand mitt (FIGS. 1*a*, 2*a*-2*g*), the perforated component 13 covers the palm of the wearer's hand, and in a foot mitt (FIGS. 1*b*, 3*a*-3*g*), the perforated component 33 covers the ball (and possibly a small part of the arch) of the wearer's foot. In each mitt, the perforated component has an outer surface portion (e.g. 16, 36) that resists the human extremity from sliding against the support surface. The perforated component also has an inner surface (e.g. 14, 34) that resists relative movement between the human extremity and the sleeve as the wearer applies pressure against a surface and takes predetermined positions relative to the surface.

Although not as preferred, it is contemplated that the sleeve may be formed by a fabric portion that covers the appropriate portions of a hand or foot, and has coatings on its inner and outer sides, the coatings designed to cause the outer surface of the mitt to resist sliding movement against a support surface and to cause the mitt to resist movement relative of the wearer's hand/foot relative to the mitt as the wearer applies downward and outward pressure against a support surface. The coatings can be formed of material (e.g. rubber, rubber/silicon) that resist relative movement between the mitt and a support surface and between the mitt and the wearer's hand/foot as the wearer applies pressure in downward and outward directions against a support surface during an exercise form such as yoga. Such construction is shown Attachment A.

In FIGS. 5 and 6, a yoga practitioner's hand and foot are shown, with hand and foot mitts thereon, and in representative positions that occur as the practitioner assumes yoga positions on a support surface. Moreover, in Attachment A, Exhibits 32-37, a yoga practitioner is wearing mitts according to an early version of the present invention on her hands and feet, is practicing yoga on a fine woolen rug, and is shifting from a yoga posture known as upward facing dog to downward facing dog. In Attachment A, Exhibits 38-42, the yoga practitioner is shifting from a yoga posture known as pigeon to a posture known as three legged dog. From the sequence of those figures, one can clearly see how the postures require downward and outward forces between the practitioner's extremities and the support surface, as the practitioner shifts positions. Moreover, one can clearly see how the ability to resist relative movement between the practitioner's extremity and the support surface, and also between the practitioner's extremity and the mitt are important features provided by the exercise mitt of the present invention.

Accordingly, from the foregoing description, applicants have provided an exercise mitt which is particularly useful to a yoga practitioner, but it will be clear to those in the art that the principles of the present invention can be used to provide an exercise mitt for exercise practitioners whose exercise forms require the same type of features as the mitts of the present invention.

The invention claimed is:

1. An assembly of hand and foot mitts for an exercise form in which pressure is applied between a human palm and a support surface and between a human foot and a support surface as the wearer takes predetermined positions of an exercise form relative to the support surface, comprising a pair of hand mitts and a pair of foot mitts, each hand mitt comprising a hand sleeve configured to fit snugly about a palm of a human hand with one or more openings that allow portions of fingers of a human hand to extend out of the hand sleeve in a manner that the portions of the fingers that extend out of the sleeve are not covered by any part of the hand mitt, the hand sleeve comprising two segments of material that are coupled together to form the hand sleeve, one of the segments of material formed of an anti slip material and having opposite surfaces, one of the opposite surfaces forming an inner surface portion of the hand sleeve and being located to directly contact a portion of the palm of a wearer of the hand sleeve and the other of the opposite surfaces forming an outer surface of the hand sleeve and being located to directly contact a support surface when the wearer seeks to apply pressure from the wearer's palm through the one segment of material and against the support surface, the outer surface portion of the hand sleeve configured to resist relative movement between the hand sleeve and the support surface as the wearer applies pressure from the wearer's palm through the one segment of material and against the support surface and takes predetermined positions relative to the support surface, the inner surface portion of the hand sleeve configured to resist relative movement between a human palm and the hand sleeve as the wearer applies pressure from the wearer's palm through the one segment of material and against the support surface as the wearer takes predetermined positions relative to the support surface, each foot mitt comprising a foot sleeve configured to fit snugly about a portion of a human foot with one or more openings that allow portions of the toes of a human foot to extend out of the foot sleeve in a manner that the portions of the toes that extend out of the foot sleeve are not covered by any part of the foot mitt, the foot sleeve comprising two segments of material that are coupled together to form the foot sleeve, one of the segments of material formed of an anti slip material and having opposite surfaces, one of the opposite surfaces forming an inner surface portion of the foot sleeve and being located to directly contact a portion of the foot of a wearer of the foot sleeve and the other of the opposite surfaces forming an outer surface of the foot sleeve and being located to directly contact a support surface when the wearer seeks to apply pressure from the wearer's foot through the one segment of material and against the support surface, the outer surface portion of the foot sleeve configured to resist relative movement between the foot sleeve and the support surface as the wearer applies pressure from the wearer's foot through the one segment of material and against the support surface and takes predetermined positions relative to the support surface, the inner surface portion of the foot sleeve configured to resist relative movement between a human foot and the foot sleeve as the wearer applies pressure from the wearer's foot through the one segment of material and against the support surface as the wearer takes predetermined positions relative to the support surface.

2. The assembly set forth in claim 1, wherein the anti slip material of each of the hand and foot sleeves comprises a poly vinyl chloride blend.

3. The assembly set forth in claim 1, wherein each of the hand and foot sleeves further includes a stretch material that is joined to the segment of material that forms the inner and outer surface portions of the hand or foot sleeve.

4. A method of performing an exercise form that requires a practitioner to assume predetermined postures on a support surface by applying pressure between one or both of the practitioner's hands and the support surface as the practitioner performs the exercise form, comprising a. providing a first pair of exercise mitts for the practitioner's hands, each exercise mitt comprising a sleeve configured to fit snugly about the palm of a human hand with one or more openings that allow portions of fingers of a human hand to extend out of the sleeve in a manner that the portions of the fingers that extend out of the sleeve are not covered by any part of the exercise mitt, the sleeve comprising two segments of material that are coupled together to form the sleeve, one of the segments of material formed of an anti slip material and having opposite surfaces, one of the opposite surfaces forming an inner surface portion of the sleeve and being located to directly contact a portion of the palm of a wearer of the sleeve and the other of the opposite surfaces forming an outer surface portion of the sleeve and being located to directly contact a support surface when the wearer seeks to apply pressure from the wearer's palm through the one segment of material and against the support surface, the outer surface portion of the sleeve configured to resist relative movement between the sleeve and the support surface as the wearer applies pressure from the wearer's palm through the one segment of material and against the support surface and takes predetermined positions relative to the support surface, the inner surface portion of the sleeve configured to resist relative movement between a human palm and the sleeve as the wearer applies pressure from the wearer's palm through the one segment of material and against the support surface as the wearer assumes predetermined postures on the support surface;

b. having the practitioner wear the first set of exercise mitts, and then practice an exercise form on the support surface in which the practitioner assumes predetermined postures of the exercise form by applying pressure between at least one of the practitioner's hand's and the support surface through the one of the segments of material forming the sleeve and also directly by portions of the practitioner's fingers that extend out of the sleeve while the practitioner is wearing the first set of exercise mitts, the sleeve resisting movement between the practitioner's palm and the support surface and also resisting movement between the practitioner's palm and the sleeve as the practitioner applies pressure through the one segment of material and against the support surface.

5. The method of claim 4, wherein a. the providing step further comprises providing a set of foot mitts for the practitioner's feet, each foot mitt comprising a foot sleeve configured to fit snugly about a human foot with one or more openings that allow portions of toes of a human foot to extend out of the foot sleeve in a manner that the portions of the toes that extend out of the foot sleeve are not covered by any part of the foot mitt, the foot sleeve comprising two segments of material that are coupled together to form the foot sleeve, one of the segments of material formed of an anti slip material and having opposite surfaces, one of the opposite surfaces forming an inner surface portion of the foot sleeve and being located to directly contact a portion of the foot of a wearer of the foot sleeve and the other of the opposite surfaces forming an outer surface of the foot sleeve and being located to directly contact a support surface when the wearer seeks to apply pressure from the wearer's foot through the one segment of material and against the support surface, the outer surface portion of the foot sleeve configured to resist relative movement between the foot sleeve and the support surface as the wearer applies pressure from the wearer's foot through the one segment of material and against the support surface and takes predetermined positions relative to the support surface, the inner surface portion of the foot sleeve configured to resist relative movement between a human foot and the foot sleeve as the wearer applies pressure from the wearer's foot through the one segment of material and against the support surface as the wearer takes predetermined positions relative to the support surface, and b. wherein the having step further comprises having the practitioner wear the set of foot mitts, and then practice an exercise form on the support surface in which the practitioner assumes predetermined postures of the exercise form by applying pressure between at least one of the practitioner's feet and the support surface through the one of the segments of material forming the foot sleeve and also directly by portions of the practitioner's toes that extend out of the foot sleeve while the practitioner is wearing the set of foot mitts, the foot sleeve resisting movement between the practitioner's foot and the support surface and also resisting movement between the practitioner's foot and the foot sleeve as the practitioner applies pressure through the one segment of material and against the support surface.

6. The method of claim 5, wherein the exercise form is yoga, and the having step comprises having the practitioner assume a yoga posture that requires the practitioner to apply pressure to a support surface through at least one of the practitioner's hands or feet.

7. The method of claim 6, wherein the having step comprises having the practitioner assume a yoga posture on a support surface that is a rug.

8. The method of claim 5, wherein the exercise form is pilates, and the having step comprises having the practitioner assume a pilates posture that requires the practitioner to apply pressure to a support surface through at least one of the practitioner's hands or feet.

9. The method of claim 4, wherein the providing step comprises providing a sleeve configured with a thumb opening that enables a portion of the practitioner's thumb to extend out of the sleeve, and at least one additional opening that enables other fingers of the practitioner's hand to extend out of the sleeve.

* * * * *